US011384413B2

(12) United States Patent
Mantione et al.

(10) Patent No.: US 11,384,413 B2
(45) **Date of Patent: *Jul. 12, 2022**

(54) HIGH TEMPERATURE TITANIUM ALLOYS

(71) Applicant: ATI Properties LLC, Albany, OR (US)

(72) Inventors: John V. Mantione, Indian Trail, NC (US); David J. Bryan, Indian Trail, NC (US); Matias Garcia-Avila, Indian Trail, NC (US)

(73) Assignee: ATI PROPERTIES LLC, Albany, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/813,049

(22) Filed: Mar. 9, 2020

(65) Prior Publication Data

US 2020/0208241 A1 Jul. 2, 2020

Related U.S. Application Data

(62) Division of application No. 15/945,037, filed on Apr. 4, 2018, now Pat. No. 10,913,991.

(51) Int. Cl.

| | |
|---|---|
| ***C22C 14/00*** | (2006.01) |
| ***C22F 1/18*** | (2006.01) |
| ***C22F 1/00*** | (2006.01) |

(52) U.S. Cl.

CPC ..... *C22C 14/00* (2013.01); *C22F 1/002* (2013.01); *C22F 1/183* (2013.01)

(58) Field of Classification Search

CPC ..... C22C 14/00; C22F 1/183

See application file for complete search history.

(56) References Cited

U.S. PATENT DOCUMENTS

| | | | |
|---|---|---|---|
| 2,893,864 | A | 7/1959 | Harris et al. |
| 2,918,367 | A | 12/1959 | Crossley et al. |
| 3,131,059 | A | 4/1964 | Kaarlela |
| 3,565,591 | A | 2/1971 | Canonico et al. |
| 3,595,645 | A | 7/1971 | Hunter et al. |
| 3,833,363 | A | 9/1974 | Bomberger, Jr. et al. |
| 3,986,868 | A | 10/1976 | Crossley |
| 4,309,226 | A | 1/1982 | Chen |
| 4,738,822 | A | 4/1988 | Bania |
| 4,842,653 | A | 6/1989 | Wirth et al. |
| 4,889,170 | A | 12/1989 | Mae et al. |
| 5,472,526 | A | 12/1995 | Gigliotti, Jr. |
| 6,800,243 | B2 | 10/2004 | Tetyukhin et al. |
| 6,921,441 | B2 | 7/2005 | Tanaka et al. |
| 7,008,489 | B2 | 3/2006 | Bania |
| 7,083,687 | B2 | 8/2006 | Tanaka et al. |
| 8,454,768 | B2 | 6/2013 | Fanning |
| 9,957,836 | B2 | 5/2018 | Sun et al. |
| 10,023,942 | B2 | 7/2018 | Schutz et al. |
| 2009/0180918 | A1 | 7/2009 | Tsai et al. |
| 2010/0326571 | A1 | 12/2010 | Deal et al. |
| 2016/0326612 | A1 | 11/2016 | Gudipati et al. |
| 2018/0200766 | A1 | 7/2018 | Kunieda et al. |
| 2019/0309393 | A1 | 10/2019 | Mantione et al. |
| 2019/0338397 | A1 | 11/2019 | Garcia-Avila et al. |
| 2020/0071806 | A1 | 3/2020 | Mantione et al. |

FOREIGN PATENT DOCUMENTS

| | | | |
|---|---|---|---|
| CA | 974095 | A1 | 9/1975 |
| CN | 1954087 | A | 4/2007 |
| CN | 101597703 | A | 12/2009 |
| CN | 101886189 | A | 11/2010 |
| EP | 0243056 | A1 | 10/1987 |
| EP | 1882752 | A2 | 1/2008 |
| GB | 888865 | | 2/1962 |
| JP | S62-267438 | A | 11/1987 |
| JP | H06-212378 | A | 8/1994 |
| JP | 2003-193159 | A | 7/2003 |
| JP | 2003-293051 | A | 10/2003 |
| JP | 2004-532785 | A | 10/2004 |
| JP | 2012-057200 | A | 3/2012 |
| JP | 2015-4100 | A | 1/2015 |
| JP | 2005-320570 | A | 11/2017 |
| RU | 1593259 | C | 11/1994 |
| RU | 2581332 | C | 4/2016 |
| SU | 524847 | A | 11/1976 |
| WO | 2004/106569 | A1 | 12/2004 |

(Continued)

OTHER PUBLICATIONS

Kansal et al., "Microstructural Banding in Thermally and Mechanically Processed Titanium 6242", Journal of Material Engineering and Performance, Springer Verlag, New York, US, vol. 1, No. 3, Jun. 1, 1992, pp. 393-398.

Kitashima et al., "Microstructure and Creep Properties of Silicon-and/or Germanium-Bearing Near-[alpha] Titanium Alloys", Materials Science Forum, vol. 879, Nov. 15, 2015, pp. 2324-2329.

ATI Ti—5Al—2Sn—2Zr—4Cr—4Mo Alloy Technical Datasheet (UNS R58650) ATI 17™, Version 1, Dec. 20, 2011, Allegheny Technologies Incorporated, 3 pages.

Crossley et al., "Cast Transage 175 Titanium Alloy for Durability Critical Structural Components", Joumal of Aircraft, vol. 20, No. 1, Jan. 1983, pp. 66-69.

(Continued)

*Primary Examiner* — Jessee R Roe

(74) *Attorney, Agent, or Firm* — Robert J. Toth; K&L Gates LLP

(57) ABSTRACT

A non-limiting embodiment of a titanium alloy comprises, in percent by weight based on total alloy weight: 5.1 to 6.5 aluminum; 1.9 to 3.2 tin; 1.8 to 3.1 zirconium; 3.3 to 5.5 molybdenum; 3.3 to 5.2 chromium; 0.08 to 0.15 oxygen; 0.03 to 0.20 silicon; 0 to 0.30 iron; titanium; and impurities. A non-limiting embodiment of the titanium alloy comprises an intentional addition of silicon in conjunction with certain other alloying additions to achieve an aluminum equivalent value of at least 6.9 and a molybdenum equivalent value of 7.4 to 12.8, which was observed to improve tensile strength at high temperatures.

37 Claims, 6 Drawing Sheets

(56) References Cited

FOREIGN PATENT DOCUMENTS

| | | | |
|---|---|---|---|
| WO | 2012/039929 | A1 | 3/2012 |
| WO | 2015/168131 | A1 | 11/2015 |
| WO | WO 2016/114956 | A1 | 7/2016 |
| WO | WO 2017/01 8511 | A1 | 2/2017 |
| WO | WO 2017/018514 | A1 | 2/2017 |

OTHER PUBLICATIONS

Inagaki et al., "Application and Features of Titanium for the Aerospace Industry", Nippon Steel & Sumitomo Metal Technical Report, No. 106, Jul. 2014, pp. 22-27.

Nyakana, "Quick reference guide for beta titanium alloys in the 00s", JMEPEG, vol. 14, 2015, pp. 799-811.

Cotton et al., "State of the Art in Beta Titanium Alloys for Airframe Applications", JOM, vol. 67, No. 6, 2015, pp. 1281-1303.

Lütjering et al., Titanium, 2nd edition, Springer, 2007, pp. 264-269.

Materials Properties Handbook: Titanium Alloys, eds. Boyer et al., Materials Park, Ohio, ASM International, 1994, 13 pages.

"Special Alloys and Forging Thereof," China Forging Association, pp. 119-122, National Defense Industry Press, Oct. 31, 2009.

"Metal Materials Science," Tang Daiming et al., pp. 251-252, Southwest Jiaotong University Press, Jun. 30, 2014.

"Engineering Materials and Metal Thermal Processing Basis," Jin Nanwei, p. 185, Aviation Industry Press, Jun. 30, 1995.

"Non-ferrous Metal Materials Science," Miao Qiang et al., p. 139, Northwestern Polytechnical University Press, Aug. 31, 2016.

Shipsha, V.G.,Titanium and Titanium Alloys, The Wayback Machine—https://web.archive.org/web/20180505165817/http://www.naukaspb.ru:80/spravochniki/Demo%20Metall/3_17.htm, accessed http://www.naukaspb.ru/spravochniki/Demo%20Metall/3_17.htm, May 5, 2018, 27 pages.

Effect of impurities on titanium alloys, accessed at https://super-splav.ru/blog/2017/05/23/vliyanie-prim+A14esei-na-titanovye-splavy/, May 23, 2017, 8 pages.

"Engineering Materials", Machinery Industry Press, edited by Zhan Wu, published Oct. 31, 1997, p. 226.

Kitashima et al., "Effect of Germanium and Silicon Additions on the Mechanical Properties of A Near-a Titanium Alloy," Materials Science & Engineering A, Jan. 8, 2014, vol. 597, pp. 212-218.

HIGH TEMPERATURE TITANIUM ALLOYS

CROSS REFERENCE TO RELATED APPLICATIONS

The present application is a divisional application claiming priority under 35 U.S.C. § 120 to co-pending U.S. patent application Ser. No. 15/945,037, now U.S. Pat. No. 10,913,991, entitled "High Temperature Titanium Alloys" filed Apr. 4, 2018, the entire disclosure of which is incorporated by reference herein for all purposes.

BACKGROUND OF THE TECHNOLOGY

Field of the Technology

The present disclosure relates to high temperature titanium alloys.

Description of the Background of the Technology

Titanium alloys typically exhibit a high strength-to-weight ratio, are corrosion resistant, and are resistant to creep at moderately high temperatures. For example, Ti-5Al-4Mo-4Cr-2Sn-2Zr alloy (also denoted "Ti-17 alloy," having a composition specified in UNS R58650) is a commercial alloy that is widely used for jet engine applications requiring a combination of high strength, fatigue resistance, and toughness at operating temperatures up to 800° F. (about 427° C.). Other examples of titanium alloys used for high temperature applications include Ti-6Al-2Sn-4Zr-2Mo alloy (having a composition specified in UNS R54620) and Ti-3Al-8V-6Cr-4Mo-4Zr alloy (also denoted "Beta-C", having a composition specified in UNS R58640). However, there are limits to creep resistance and/or tensile strength at elevated temperatures in these alloys. There has developed a need for titanium alloys having improved creep resistance and/or tensile strength at elevated temperatures.

SUMMARY

According to one non-limiting aspect of the present disclosure, a titanium alloy comprises, in percent by weight based on total alloy weight: 5.5 to 6.5 aluminum; 1.9 to 2.9 tin; 1.8 to 3.0 zirconium; 4.5 to 5.5 molybdenum; 4.2 to 5.2 chromium; 0.08 to 0.15 oxygen; 0.03 to 0.20 silicon; 0 to 0.30 iron; titanium; and impurities.

According to yet another non-limiting aspect of the present disclosure, a titanium alloy comprises, in percent by weight based on total alloy weight: 5.1 to 6.1 aluminum; 2.2 to 3.2 tin; 1.8 to 3.1 zirconium; 3.3 to 4.3 molybdenum; 3.3 to 4.3 chromium; 0.08 to 0.15 oxygen; 0.03 to 0.20 silicon; 0 to 0.30 iron; titanium; and impurities.

BRIEF DESCRIPTION OF THE DRAWINGS

The features and advantages of alloys, articles, and methods described herein may be better understood by reference to the accompanying drawings in which.

Figure 1:
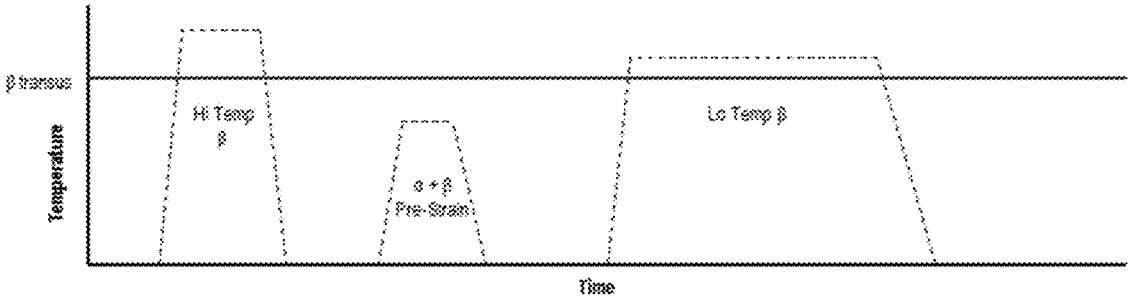
FIG. 1 is a plot illustrating a non-limiting embodiment of a method of processing a non-limiting embodiment of a titanium alloy according to the present disclosure.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

In the present description of non-limiting embodiments, other than in the operating examples or where otherwise indicated, all numbers expressing quantities or characteristics are to be understood as being modified in all instances by the term "about". Accordingly, unless indicated to the contrary, any numerical parameters set forth in the following description are approximations that may vary depending on the desired properties one seeks to obtain in the materials and by the methods according to the present disclosure. At the very least, and not as an attempt to limit the application of the doctrine of equivalents to the scope of the claims, each numerical parameter should at least be construed in light of the number of reported significant digits and by applying ordinary rounding techniques. All ranges described herein are inclusive of the described endpoints unless stated otherwise.

Any patent, publication, or other disclosure material that is said to be incorporated, in whole or in part, by reference herein is incorporated herein only to the extent that the incorporated material does not conflict with existing definitions, statements, or other disclosure material set forth in the present disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

Articles and parts in high temperature environments may suffer from creep. As used herein, "high temperature" refers to temperatures in excess of about 100° F. (about 37.8° C.). Creep is time-dependent strain occurring under stress. Creep occurring at a diminishing strain rate is referred to as primary creep; creep occurring at a minimum and almost constant strain rate is referred to as secondary (steady-state) creep; and creep occurring at an accelerating strain rate is referred to as tertiary creep. Creep strength is the stress that will cause a given creep strain in a creep test at a given time in a specified constant environment.

The creep resistance behavior of titanium and titanium alloys at high temperature and under a sustained load depends primarily on microstructural features. Titanium has two allotropic forms: a beta ("β")-phase, which has a body centered cubic ("bcc") crystal structure; and an alpha ("α")-phase, which has a hexagonal close packed ("hcp") crystal structure. In general, p titanium alloys have poor elevated-temperature creep strength. The poor elevated-temperature creep strength is a result of the significant concentration of β phase these alloys exhibit at elevated temperatures such as, for example, 500° C. β phase does not resist creep well due to its body centered cubic structure, which provides for a large number of deformation mechanisms. As a result of these shortcomings, the use of β titanium alloys has been limited.

One group of titanium alloys widely used in a variety of applications is the α/β titanium alloy. In α/β titanium alloys, the distribution and size of the primary α particles can directly impact the creep resistance. According to various published accounts of research on α/β titanium alloys containing silicon, the precipitation of silicides at the grain boundaries can further improve creep resistance, but to the detriment of room temperature tensile ductility. The reduction in room temperature tensile ductility that occurs with silicon addition limits the amount of silicon that can be added, typically, to 0.2% (by weight).

The present disclosure, in part, is directed to alloys that address certain of the limitations of conventional titanium alloys. FIG. 1 is a diagram illustrating a non-limiting embodiment of a method of processing a non-limiting embodiment of a titanium alloy according to the present disclosure. An embodiment of the titanium alloy according to the present disclosure includes, in percent by weight based on total alloy weight, 5.5 to 6.5 aluminum, 1.9 to 2.9 tin, 1.8 to 3.0 zirconium, 4.5 to 5.5 molybdenum, 4.2 to 5.2 chromium, 0.08 to 0.15 oxygen, 0.03 to 0.20 silicon, 0 to 0.30 iron, titanium, and impurities. Another embodiment of the titanium alloy according to the present disclosure includes, in weight percentages based on total alloy weight, 5.5 to 6.5 aluminum, 2.2 to 2.6 tin, 2.0 to 2.8 zirconium, 4.8 to 5.2 molybdenum, 4.5 to 4.9 chromium, 0.08 to 0.13 oxygen, 0.03 to 0.11 silicon, 0 to 0.25 iron, titanium, and impurities. Yet another embodiment of the titanium alloy according to the present disclosure includes, in weight percentages based on total alloy weight, 5.9 to 6.0 aluminum, 2.3 to 2.5 tin, 2.3 to 2.6 zirconium, 4.9 to 5.1 molybdenum, 4.5 to 4.8 chromium, 0.08 to 0.13 oxygen, 0.03 to 0.10 silicon, up to 0.07 iron, titanium, and impurities. In non-limiting embodiments of alloys according to this disclosure, incidental elements and impurities in the alloy composition may comprise or consist essentially of one or more of nitrogen, carbon, hydrogen, niobium, tungsten, vanadium, tantalum, manganese, nickel, hafnium, gallium, antimony, cobalt, and copper. Certain non-limiting embodiments of titanium alloys according to the present disclosure may comprise, in weight percentages based on total alloy weight, 0 to 0.05 nitrogen, 0 to 0.05 carbon, 0 to 0.015 hydrogen, and 0 up to 0.1 of each of niobium, tungsten, hafnium, nickel, gallium, antimony, vanadium, tantalum, manganese, cobalt, and copper.

In certain non-limiting embodiments of the present titanium alloy, the titanium alloy comprises an intentional addition of silicon in conjunction with certain other alloying additions to achieve an aluminum equivalent value of 6.9 to 9.5 and a molybdenum equivalent value of 7.4 to 12.8, which the inventers have observed improves tensile strength at high temperatures. As used herein, "aluminum equivalent value" or "aluminum equivalent" ($Al_{eq}$) may be determined as follows (wherein all elemental concentrations are in weight percentages, as indicated): $Al_{eq}=Al_{(wt.\ \%)}+(1/6)\times Zr_{(wt.\ \%)}+(1/3)\times Sn_{(wt.\ \%)}+10\times O_{(wt.\ \%)}$. As used herein, "molybdenum equivalent value" or "molybdenum equivalent" ($Mo_{eq}$) may be determined as follows (wherein all elemental concentrations are in weight percentages, as indicated): $Mo_{eq}=Mo_{(wt.\ \%)}+(1/5)\times Ta_{(wt.\ \%)}+(1/3.6)\times Nb_{(wt.\ \%)}+(1/2.5)\times W_{(wt.\ \%)}+(1/1.5)\times V_{(wt.\ \%)}+1.25\times Cr_{(wt.\ \%)}+1.25\times Ni_{(wt.\ \%)}+1.7\times Mn_{(wt.\ \%)}+1.7\times Co_{(wt.\ \%)}+2.5\times Fe_{(wt.\ \%)}$.

While it is recognized that the mechanical properties of titanium alloys are generally influenced by the size of the specimen being tested, in non-limiting embodiments according to the present disclosure, a titanium alloy comprises an aluminum equivalent value of at least 6.9, or in certain embodiments within the range of 8.0 to 9.5, a molybdenum equivalent value of 9.0 to 12.8, and exhibits an ultimate tensile strength of at least 160 ksi and at least 10% elongation at 316° C. In other non-limiting embodiments according to the present disclosure, a titanium alloy comprises an aluminum equivalent value of at least 6.9, or in certain embodiments within the range of 8.0 to 9.5, a molybdenum equivalent value of 8.0 to 12.8, and exhibits a yield strength of at least 150 ksi and at least 10% elongation at 316° C. In yet other non-limiting embodiments, a titanium alloy according to the present disclosure comprises an aluminum equivalent value of at least 6.9, or in certain embodiments within the range of 6.9 to 9.5, a molybdenum equivalent value of 7.4 to 12.8, and exhibits a time to 0.2% creep strain of no less than 20 hours at 427° C. under a load of 60 ksi. In yet other non-limiting embodiments, a titanium alloy according to the present disclosure comprises an aluminum equivalent value of at least 6.9, or in certain embodiments within the range of 8.0 to 9.5, a molybdenum equivalent value of 7.4 to 10.4, and exhibits a time to 0.2% creep strain of no less than 86 hours at 427° C. under a load of 60 ksi.

Table 1 list elemental compositions, $Al_{eq}$, and $Mo_{eq}$ of non-limiting embodiments of a titanium alloy according to the present disclosure ("Experimental Titanium Alloy No. 1" and "Experimental Alloy No. 2"), an embodiment of a comparative titanium alloy that does not include an intentional silicon addition, and embodiments of certain conventional titanium alloys. Without intending to be bound to any theory, it is believed that the silicon content of the Experimental Titanium Alloy No. 1 and the Experimental Titanium Alloy No. 2 listed in Table 1 may promote precipitation of one or more silicide phases.

TABLE 1

| Alloy | Al (wt %) | V (wt %) | Fe (wt %) | Sn (wt %) | Cr (wt %) | Zr (wt %) | Mo (wt %) | Nb (wt %) | Si (wt %) | O (wt %) | Al-Eq | Mo-Eq |
|---|---|---|---|---|---|---|---|---|---|---|---|---|
| Ti64 (UNS R56400) | 6 | 4 | 0.4 | — | — | — | — | — | <0.03 | 0.20 | 8.0 | 3.7 |
| Ti834 | 5.8 | — | 0.05 | 4 | — | 3.5 | 0.5 | 0.7 | 0.3 | 0.15 | 9.2 | 0.8 |
| Ti6242Si (UNS R54620) | 6 | — | 0.25 | 2 | — | 4 | 2 | — | 0.1 | 0.15 | 8.8 | 2.6 |
| Ti17 (UNS 58650) | 5 | — | 0.3 | 2 | 4 | 2 | 4 | — | <0.03 | 0.13 | 7.3 | 9.8 |

TABLE 1-continued

| Alloy | Al (wt %) | V (wt %) | Fe (wt %) | Sn (wt %) | Cr (wt %) | Zr (wt %) | Mo (wt %) | Nb (wt %) | Si (wt %) | O (wt %) | Al-Eq | Mo-Eq |
|---|---|---|---|---|---|---|---|---|---|---|---|---|
| Ti38644 (UNS R58640) | 3 | 8 | 0.3 | — | 6 | 4 | 4 | — | <0.03 | 0.12 | 4.9 | 17.6 |
| Comparative Titanium Alloy | 5.9 | — | 0.07 | 2.4 | 4.6 | 2.4 | 5 | — | 0.02 | 0.13 | 8.4 | 10.9 |
| Experimental Titanium Alloy No. 1 | 6 | — | 0.06 | 2.4 | 4.7 | 2.5 | 5 | — | 0.04 | 0.13 | 8.5 | 11.0 |
| Experimental Titanium Alloy No. 2 | 5.6 | — | 0.06 | 2.7 | 3.8 | 2.6 | 3.8 | | .05 | 0.13 | 8.3 | 8.7 |

Numerous plasma arc melt (PAM) heats of the Comparative Titanium Alloy and Experimental Titanium Alloy No. 1 listed in Table 1 were produced using plasma arc furnaces to produce 9 inch diameter electrodes, each weighing approximately 400-800 lb. The electrodes were remelted in a vacuum arc remelt (VAR) furnace to produce 10 inch diameter ingots. Each ingot was converted to a 3 inch diameter billet using a hot working press. After a β forging step to 7 inch diameter, an α+β prestrain forging step to 5 inch diameter, and a β finish forging step to 3 inch diameter, the ends of each billet were cropped to remove suck-in and end-cracks, and the billets were cut into multiple pieces. The top of each billet and the bottom of the bottom-most billet at 7 inch diameter were sampled for chemistry and β transus. Based on the intermediate billet chemistry results, 2 inch long samples were cut from the billets and "pancake"-forged on the press. The pancake specimens were heat treated using the following heat treatment profile, corresponding to a solution treated and aged condition: solution treating the titanium alloy at 800° C. for 4 hours; water quenching the titanium alloy to ambient temperature; aging the titanium alloy at 635° C. for 8 hours; and air cooling the titanium alloy.

As used herein, a "solution treating and aging (STA)" process refers to a heat treating process applied to titanium alloys that includes solution treating a titanium alloy at a solution treating temperature below the β-transus temperature of the titanium alloy. In a non-limiting embodiment, the solution treating temperature is in a temperature range from about 800° C. to about 860° C. The solution treated alloy is subsequently aged by heating the alloy for a period of time to an aging temperature range that is less than the β-transus temperature and less than the solution treating temperature of the titanium alloy. As used herein, terms such as "heated to" or "heating to", etc., with reference to a temperature, a temperature range, or a minimum temperature, mean that the alloy is heated until at least the desired portion of the alloy has a temperature at least equal to the referenced or minimum temperature, or within the referenced temperature range throughout the portion's extent. In a non-limiting embodiment, a solution treatment time ranges from about 30 minutes to about 4 hours. It is recognized that in certain non-limiting embodiments, the solution treatment time may be shorter than 30 minutes or longer than 4 hours and is generally dependent upon the size and cross-section of the titanium alloy. Upon completion of the solution treatment, the titanium alloy is cooled to ambient temperature at a rate depending on a cross-sectional thickness of the titanium alloy.

The solution treated titanium alloy is subsequently aged at an aging temperature, also referred to herein as an "age hardening temperature", that is in the α+β two-phase field below the β transus temperature of the titanium alloy. In a non-limiting embodiment, the aging temperature is in a temperature range from about 620° C. to about 650° C. In certain non-limiting embodiments, the aging time may range from about 30 minutes to about 8 hours. It is recognized that in certain non-limiting embodiments, the aging time may be shorter than 30 minutes or longer than 8 hours, and is generally dependent upon the size and cross-section of the titanium alloy product form. General techniques used in STA processing of titanium alloys are known to practitioners of ordinary skill in the art and, therefore, are not further discussed herein.

Test blanks for room and high temperature tensile tests, creep tests, fracture toughness, and microstructure analysis were cut from the STA processed pancake specimens. A final chemistry analysis was performed on the fracture toughness coupon after testing to ensure accurate correlation between chemistry and mechanical properties.

Figure 2:
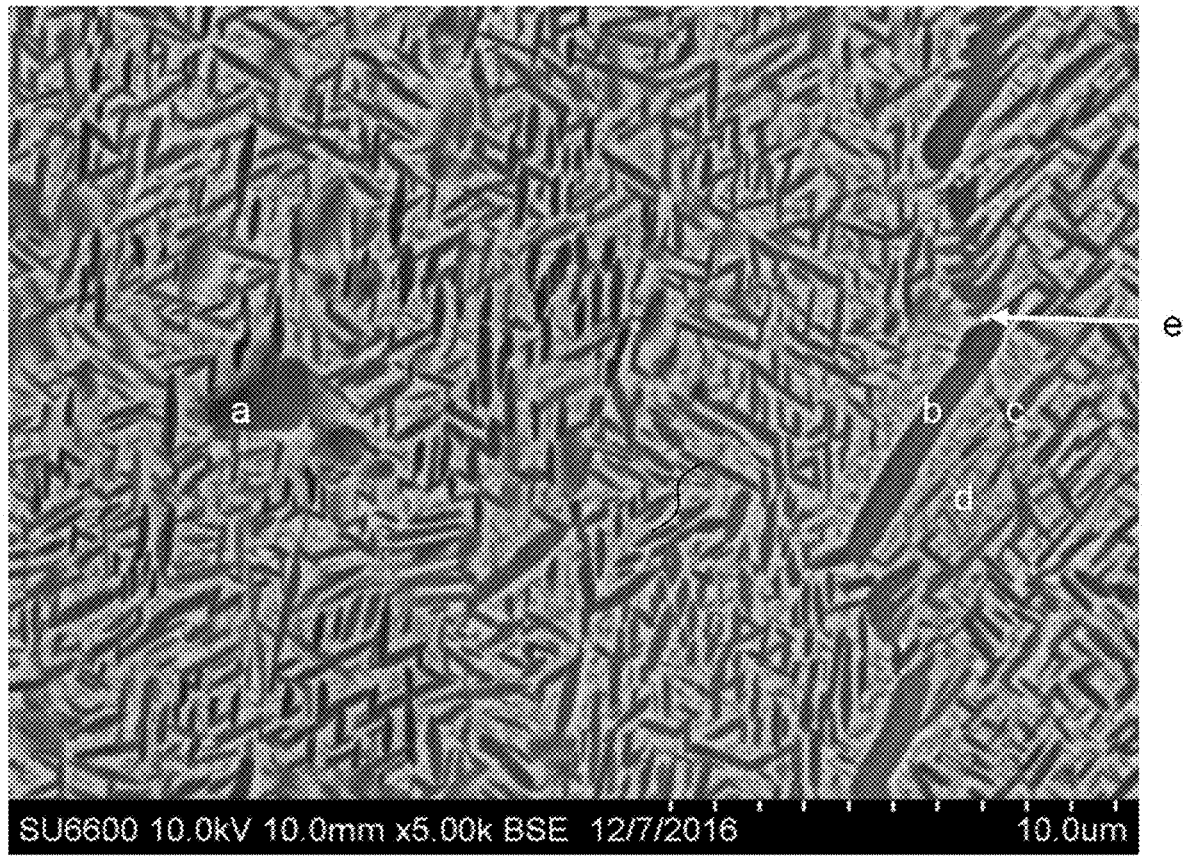
FIG. 2 is a scanning electron microscopy image (in backscatter electron mode) of a titanium alloy processed as in FIG. 1, wherein "a" identifies primary α, "b" identifies grain boundary α, "c" identifies α laths, "d" identifies secondary α, and "e" identifies a silicide.

Examination of the final 3 inch diameter billet revealed a uniform lamellar alpha/beta microstructure. Referring to FIG. 2 (showing Experimental Titanium Alloy No. 1 listed in Table 1) and FIG. 3 (showing the Comparative Titanium Alloy listed in Table 1), metallography on samples removed from the forged and STA heat treated pancake samples revealed a fine network of Widmanstätten α with some primary α and grain boundary α. Notably, Experimental Titanium Alloy No. 1 included silicide precipitates (see FIG. 2, wherein a silicide precipitate is identified as "e"), while the Comparative Titanium Alloy listed in Table 1 did not (see FIG. 3).

Figure 4:
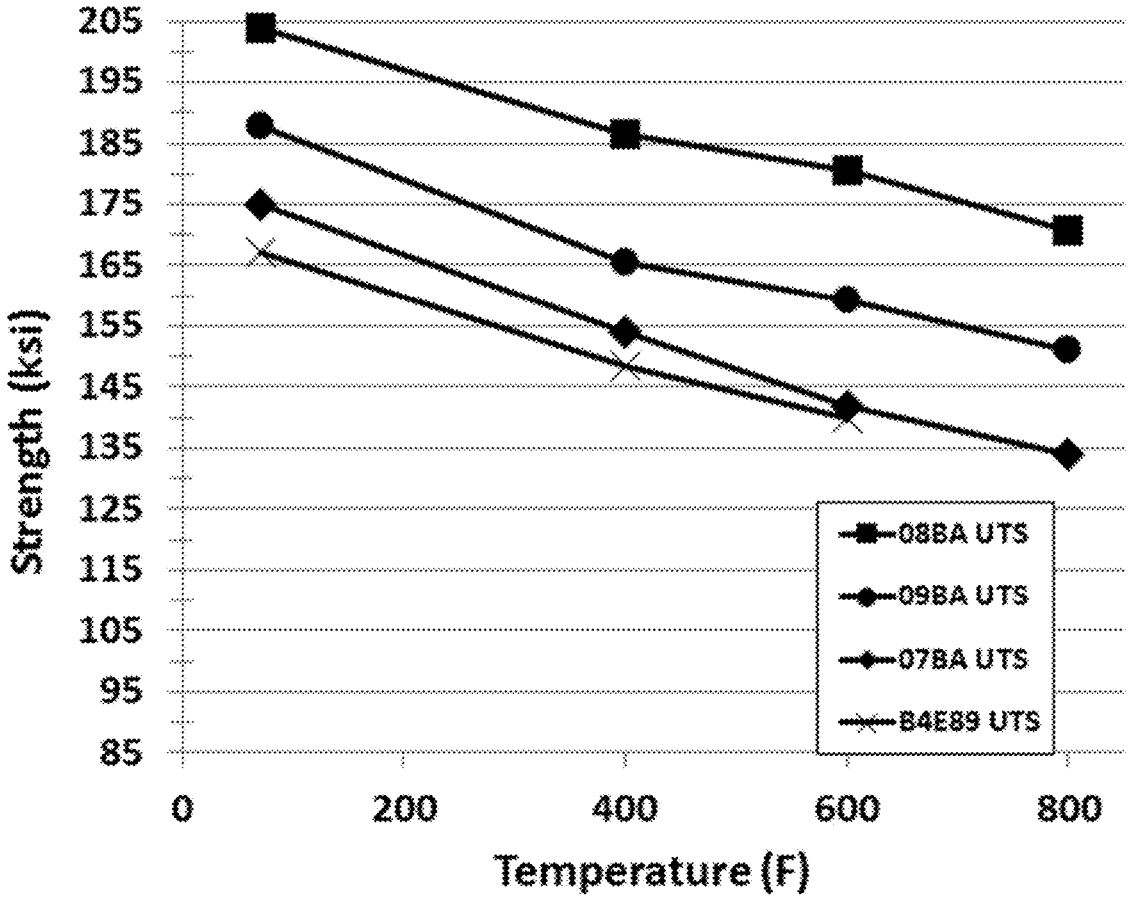
FIG. 4 is a plot of ultimate tensile strength versus temperature for non-limiting embodiments of a titanium alloy according to the present disclosure, comparing those properties with a comparative titanium alloy and conventional titanium alloys.
Figure 5:
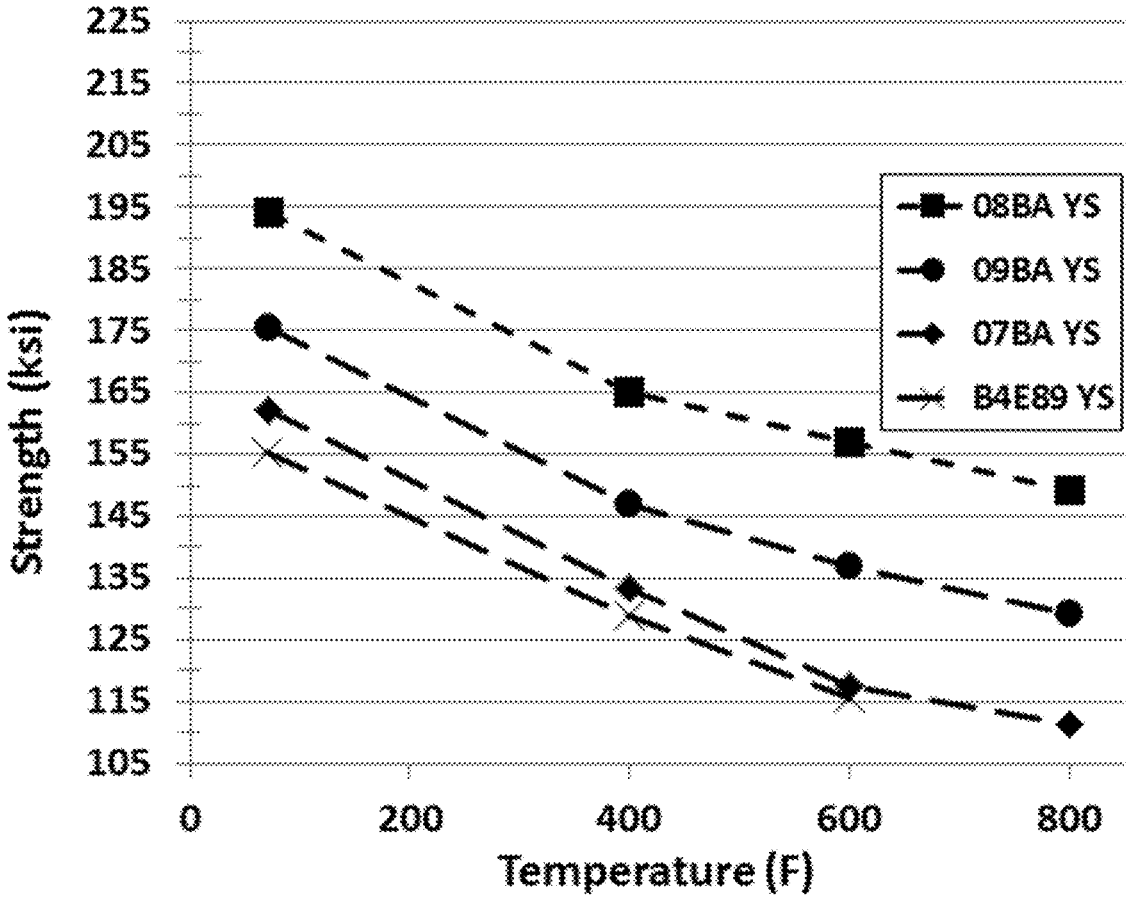
FIG. 5 is a plot of yield strength versus temperature for non-limiting embodiments of a titanium alloy according to the present disclosure, comparing those properties with a comparative titanium alloy and conventional titanium alloys.

Referring to FIGS. 4-5, mechanical properties of Experimental Titanium Alloy No. 1 listed in Table 1 (denoted "08BA" in FIGS. 4-5) were measured and compared to those of the Comparative Titanium Alloy listed in Table 1 (denoted "07BA" in FIGS. 4-5) and conventional Ti17 alloy (having a composition specified in UNS-R58650, denoted "B4E89" in FIGS. 4-5). Tensile tests were conducted according to the American Society for Testing and Materials (ASTM) standard E8/E8M-09 ("Standard Test Methods for Tension Testing of Metallic Materials", ASTM International, 2009). As shown by the experimental results in Table 2, Experimental Titanium Alloy No. 1 exhibited significantly greater ultimate tensile strength, yield strength, and ductility (reported as % elongation) at 316° C. relative to the Comparative Titanium Alloy and certain conventional titanium alloys which did not include an intentional silicon addition (for example Ti64 and Ti17 alloys), and relative to certain conventional titanium alloys including intentional silicon additions (for example Ti834 and Ti6242Si alloys).

TABLE 2

| Alloy | Temperature (° C.) | UTS (ksi) | 0.2% YS (ksi) | % Elong. |
|---|---|---|---|---|
| Ti64 | 316 | 114 | 90 | not reported |
| Ti834 | 316 | 120 | 100 | 11 |
| Ti6242Si | 204 | 129 | 112 | 11 |
| Ti17 | 204 | 149 | 129 | 11 |
| Ti17 | 316 | 140-145 | 116-120 | 11-15 |
| Ti38644 | 316 | 157 | 131 | 12 |
| Comparative Titanium | 204 | 154 | 134 | 6 |
| Alloy | 316 | 142 | 118 | 16 |
| Experimental Titanium | 204 | 187 | 165 | 11 |
| Alloy No. 1 | 316 | 180 | 157 | 12 |
| Experimental Titanium | 204 | 165.4 | 146.9 | 14 |
| Alloy No. 2 | 316 | 159.4 | 136.8 | 15 |

The high temperature tensile test results and creep test results at 427° C. for the Experimental Titanium Alloy No. 1 listed in Table 1 (with intentional silicon addition) and Experimental Titanium Alloy No. 2 listed in Table 1 (with intentional silicon addition) were compared to those of the Comparative Titanium Alloy of Table 1 (without an intentional silicon addition) and certain of the conventional titanium alloy samples listed in Table 1. The data is shown in Table 3. Experimental Titanium Alloy No. 1, for example, exhibited an approximately 25% increase in UTS and an approximately 77% increase in creep life at 427° C. relative to the Comparative Titanium Alloy.

TABLE 3

| | Tensile Properties (427° C.) | | | | Creep time (hr) to 0.2% strain under |
|---|---|---|---|---|---|
| Alloy | UTS (ksi) | YS (ksi) | % Elong | % RA | a 60 ksi load (427° C.) |
| Ti64 | — | — | — | — | 11 |
| Ti6242Si | — | — | — | — | 150+ |
| Ti17 | — | — | — | — | 16-30 |
| Comparative Titanium Alloy | 134.0 | 111.3 | 20.4 | 62.5 | 13.3 |
| Experimental Titanium Alloy No. 1 | 170.6 | 149.3 | 14.5 | 28.2 | 23.5 |
| Experimental Titanium Alloy No. 2 | 151.1 | 129.3 | 15.6 | — | 90.4 |

Certain alternative titanium alloy embodiments are now described. According to one non-limiting aspect of the present disclosure, a titanium alloy comprises, in percent by weight based on total alloy weight, 5.1 to 6.1 aluminum, 2.2 to 3.2 tin, 1.8 to 3.1 zirconium, 3.3 to 4.3 molybdenum, 3.3 to 4.3 chromium, 0.08 to 0.15 oxygen, 0.03 to 0.20 silicon, 0 to 0.30 iron, titanium, and impurities. Yet another embodiment of the titanium alloy according to the present disclosure includes, in weight percentages based on total alloy weight, 5.1 to 6.1 aluminum, 2.2 to 3.2 tin, 2.1 to 3.1 zirconium, 3.3 to 4.3 molybdenum, 3.3 to 4.3 chromium, 0.08 to 0.15 oxygen, 0.03 to 0.11 silicon, 0 to 0.30 iron, titanium, and impurities. A further embodiment of the titanium alloy according to the present disclosure includes, in weight percentages based on total alloy weight, 5.6 to 5.8 aluminum, 2.5 to 2.7 tin, 2.6 to 2.7 zirconium, 3.8 to 4.0 molybdenum, 3.7 to 3.8 chromium, 0.08 to 0.14 oxygen, 0.03 to 0.05 silicon, up to 0.06 iron, titanium, and impurities. In non-limiting embodiments of alloys according to this disclosure, incidental elements and impurities in the alloy composition may comprise or consist essentially of one or more of nitrogen, carbon, hydrogen, niobium, tungsten, vanadium, tantalum, manganese, nickel, hafnium, gallium, antimony, cobalt and copper. In certain embodiments of the titanium alloys according to the present disclosure, 0 to 0.05 nitrogen, 0 to 0.05 carbon, 0 to 0.015 hydrogen, and 0 up to 0.1 each of niobium, tungsten, hafnium, nickel, gallium, antimony, vanadium, tantalum, manganese, cobalt, and copper may be present in the titanium alloys disclosed herein.

Figure 3:
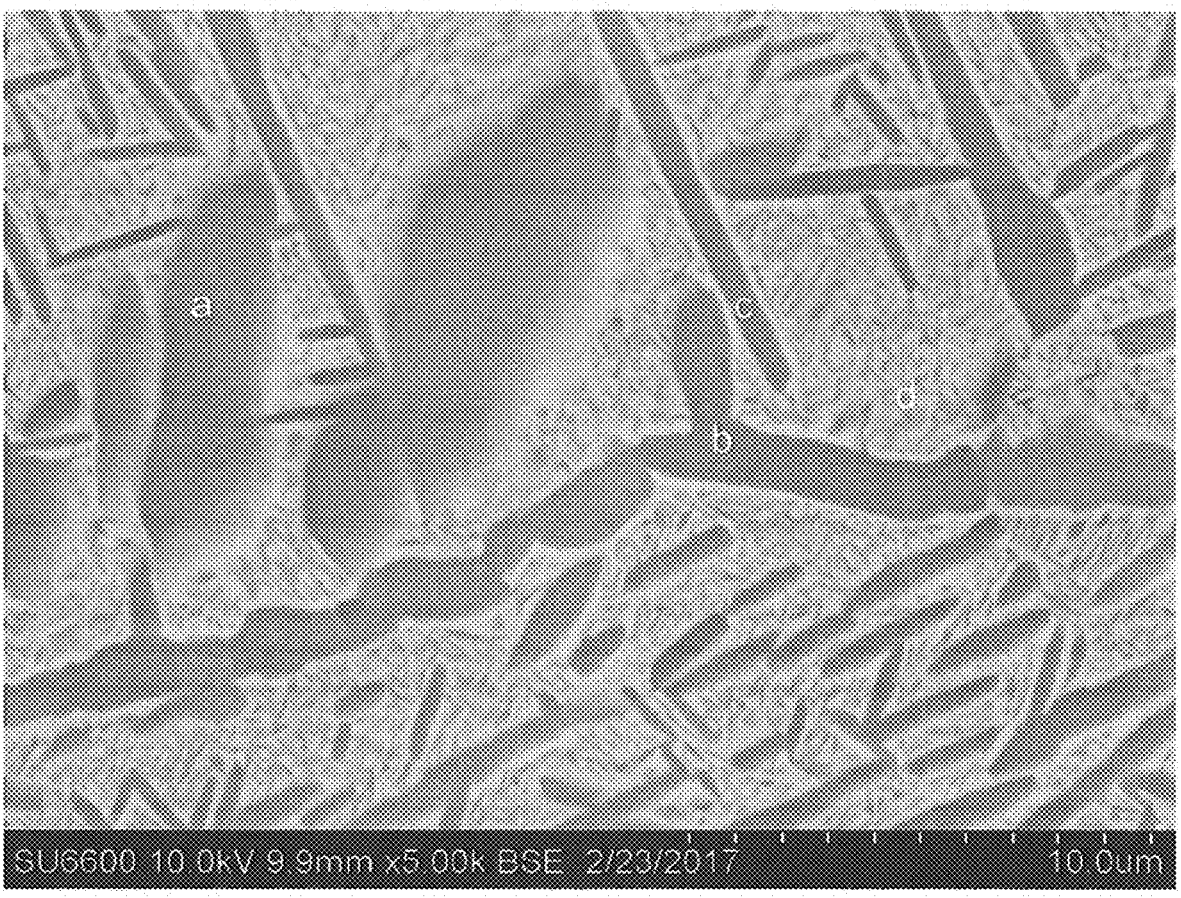
FIG. 3 is a scanning electron microscopy image (in backscatter electron mode) of a comparative solution treated and aged titanium alloy, wherein "a" identifies primary α, "b" identifies boundary α, "c" identifies α laths, and "d" identifies secondary α.

Similar to the titanium alloy illustrated in FIGS. 1-3 and described in connection with those figures, an alternative titanium alloy comprises an intentional addition of silicon. However, the alternative titanium alloy embodiments include a reduced chromium content relative to the experimental titanium alloy illustrated in and described in connection with FIGS. 1-3. Table 1 lists the composition of a non-limiting embodiment of the alternative titanium alloy ("Experimental Titanium Alloy No. 2") having a reduced chromium content and an intentional silicon addition.

In certain non-limiting embodiments of the titanium alloy according to the present disclosure, the titanium alloy comprises an intentional addition of silicon in conjunction with certain other alloying additions to achieve an aluminum equivalent value of at least 6.9 and a molybdenum equivalent value of 7.4 to 12.8, which was observed to improve tensile strength at high temperatures. In non-limiting embodiments according to the present disclosure, a titanium alloy comprises an aluminum equivalent value of at least 6.9, or in certain embodiments within the range of 6.9 to 9.5, a molybdenum equivalent value of 7.4 to 12.8, and exhibits an ultimate tensile strength of at least 150 ksi at 316° C. In other non-limiting embodiments according to the present disclosure, a titanium alloy comprises an aluminum equivalent value of at least 6.9, or in certain embodiments within the range of 8.0 to 9.5, a molybdenum equivalent value of 7.4 to 12.8, and exhibits a yield strength of at least 130 ksi at 316° C. In yet other non-limiting embodiments, a titanium alloy according to the present disclosure comprises an aluminum equivalent value of at least 6.9, or in certain embodiments within the range of 8.0 to 9.5, a molybdenum equivalent value of 7.4 to 12.8, and exhibits a time to 0.2% creep strain of no less than 86 hours at 427° C. under a load of 60 ksi.

Figure 6:
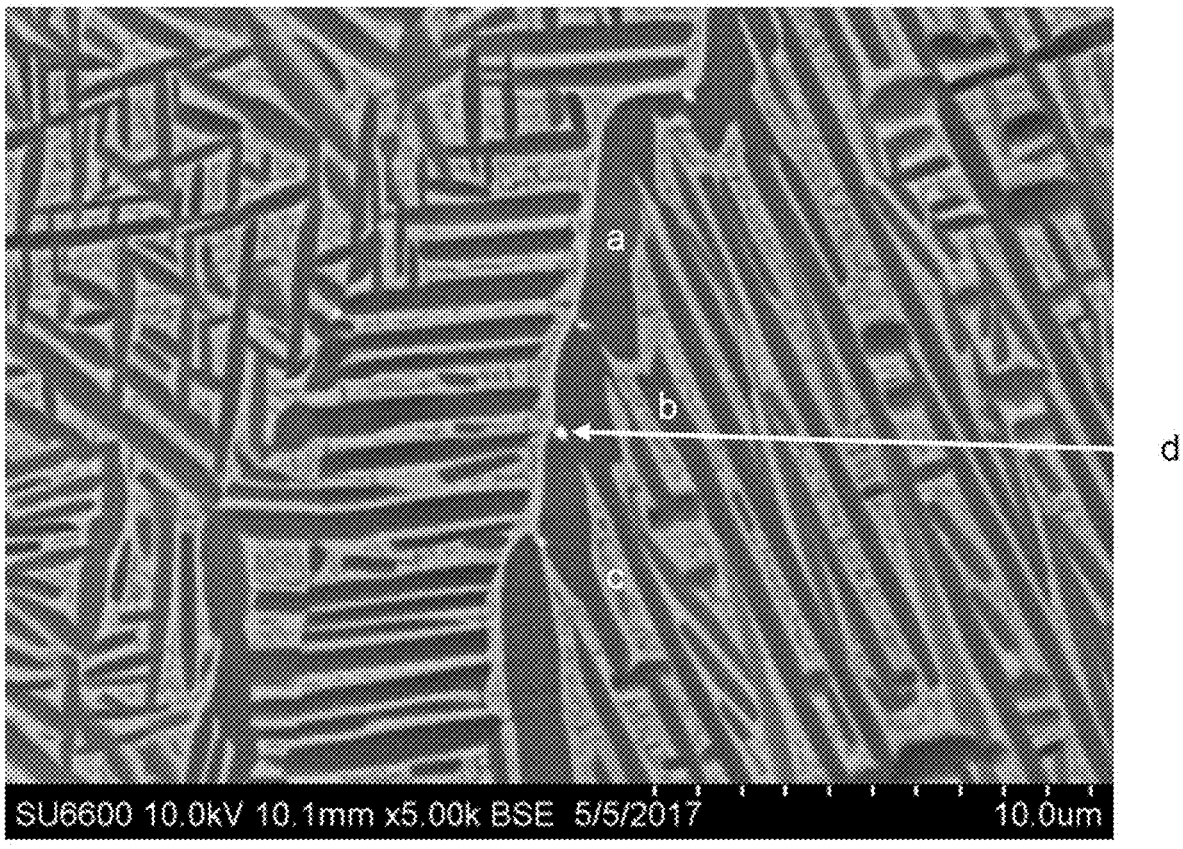
FIG. 6 is a scanning electron microscopy image (in backscatter electron mode) of a non-limiting embodiment of a titanium alloy according to the present disclosure, wherein "a" identifies grain boundary α, "b" identifies α laths, "c" identifies secondary α, and "d" identifies a silicide.

The high temperature tensile test results and creep test results of Experimental Titanium Alloy No. 2 in Table 1 at 800° F. (427° C.) are listed in Table 3. Prior to testing, the alloys were subjected to the heat treatments identified in the embodiments described above in connection with FIGS. 1-3: solution treating the titanium alloy at 800° C. for 4 hours; water quenching the titanium alloy to ambient temperature; aging the titanium alloy at 635° C. for 8 hours; and air cooling the titanium alloy. Referring to FIG. 6, metallography on the STA heat treated Experimental Alloy No. 2 revealed silicide precipitates (one precipitate identified as "d"). Without intending to be bound to any theory, it is believed that the silicon content of Experimental Titanium Alloy No. 2 listed in Table 1 may promote precipitation of this silicide phase.

Certain embodiments of alloys produced according the present disclosure and articles made from those alloys may be advantageously applied in aeronautical parts and components such as, for example, jet engine turbine discs and turbofan blades. Those having ordinary skill in the art will be capable of fabricating the foregoing equipment, parts, and other articles of manufacture from alloys according to the present disclosure without the need to provide further description herein. The foregoing examples of possible applications for alloys according to the present disclosure are offered by way of example only, and are not exhaustive of all applications in which the present alloy product forms may be applied. Those having ordinary skill, upon reading the present disclosure, may readily identify additional applications for the alloys as described herein.

Various non-exhaustive, non-limiting aspects of novel alloys according to the present disclosure may be useful alone or in combination with one or more other aspect described herein. Without limiting the foregoing description, in a first non-limiting aspect of the present disclosure, a titanium alloy comprises, in percent by weight based on total alloy weight: 5.5 to 6.5 aluminum; 1.9 to 2.9 tin; 1.8 to 3.0 zirconium; 4.5 to 5.5 molybdenum; 4.2 to 5.2 chromium; 0.08 to 0.15 oxygen; 0.03 to 0.20 silicon; 0 to 0.30 iron; titanium; and impurities.

In accordance with a second non-limiting aspect of the present disclosure, which may be used in combination with the first aspect, the titanium alloy comprises, in weight percentages based on total alloy weight: 5.5 to 6.5 aluminum; 2.2 to 2.6 tin; 2.0 to 2.8 zirconium; 4.8 to 5.2 molybdenum; 4.5 to 4.9 chromium; 0.08 to 0.13 oxygen; 0.03 to 0.11 silicon; 0 to 0.25 iron; titanium; and impurities.

In accordance with a third non-limiting aspect of the present disclosure, which may be used in combination with each or any of the above-mentioned aspects, the titanium alloy comprises, in weight percentages based on total alloy weight: 5.9 to 6.0 aluminum; 2.3 to 2.5 tin; 2.3 to 2.6 zirconium; 4.9 to 5.1 molybdenum; 4.5 to 4.8 chromium; 0.08 to 0.13 oxygen; 0.03 to 0.10 silicon; up to 0.07 iron; titanium; and impurities.

In accordance with a fourth non-limiting aspect of the present disclosure, which may be used in combination with each or any of the above-mentioned aspects, the titanium alloy further comprises, in weight percentages based on total alloy weight: 0 to 0.05 nitrogen; 0 to 0.05 carbon; 0 to 0.015 hydrogen, and 0 up to 0.1 each of niobium, tungsten, hafnium, nickel, gallium, antimony, vanadium, tantalum, manganese, cobalt, and copper.

In accordance with a fifth non-limiting aspect of the present disclosure, which may be used in combination with each or any of the above-mentioned aspects, the titanium alloy comprises an aluminum equivalent value of at least 6.9 and a molybdenum equivalent value of 7.4 to 12.8, and exhibits an ultimate tensile strength of at least 160 ksi at 316° C.

In accordance with a sixth non-limiting aspect of the present disclosure, which may be used in combination with each or any of the above-mentioned aspects, the titanium alloy comprises an aluminum equivalent value of at least 6.9 and a molybdenum equivalent value of 7.4 to 12.8, and exhibits a yield strength of at least 140 ksi at 316° C.

In accordance with a seventh non-limiting aspect of the present disclosure, which may be used in combination with each or any of the above-mentioned aspects, the titanium alloy comprises an aluminum equivalent value of at least 6.9 and a molybdenum equivalent value of 7.4 to 12.8, and exhibits a time to 0.2% creep strain of at least 20 hours at 427° C. under a load of 60 ksi.

In accordance with an eighth non-limiting aspect of the present disclosure, which may be used in combination with each or any of the above-mentioned aspects, the titanium alloy comprises an aluminum equivalent value of 8.0 to 9.5 and a molybdenum equivalent value of 7.4 to 12.8, and exhibits an ultimate tensile strength of at least 160 ksi at 316° C.

In accordance with a ninth non-limiting aspect of the present disclosure, which may be used in combination with each or any of the above-mentioned aspects, the titanium alloy comprises an aluminum equivalent value of 8.0 to 9.5 and a molybdenum equivalent value of 7.4 to 12.8, and exhibits a yield strength of at least 140 ksi at 316° C.

In accordance with a tenth non-limiting aspect of the present disclosure, which may be used in combination with each or any of the above-mentioned aspects, the titanium alloy comprises an aluminum equivalent value of 8.0 to 9.5 and a molybdenum equivalent value of 7.4 to 12.8, and exhibits a time to 0.2% creep strain of at least 20 hours at 427° C. under a load of 60 ksi.

In accordance with an eleventh non-limiting aspect of the present disclosure, which may be used in combination with each or any of the above-mentioned aspects, the titanium alloy is prepared by a process comprising: solution treating the titanium alloy at 800° C. to 860° C. for 4 hours; cooling the titanium alloy to ambient temperature at a rate depending on a cross-sectional thickness of the titanium alloy; aging the titanium alloy at 620° C. to 650° C. for 8 hours; and air cooling the titanium alloy.

In accordance with a twelfth non-limiting aspect of the present disclosure, the present disclosure also provides a titanium alloy comprising, in percent by weight based on total alloy weight: 5.1 to 6.1 aluminum; 2.2 to 3.2 tin; 1.8 to 3.1 zirconium; 3.3 to 4.3 molybdenum; 3.3 to 4.3 chromium; 0.08 to 0.15 oxygen; 0.03 to 0.20 silicon; 0 to 0.30 iron; titanium; and impurities.

In accordance with a thirteenth non-limiting aspect of the present disclosure, which may be used in combination with each or any of the above-mentioned aspects, the titanium alloy comprises, in weight percentages based on total alloy weight: 5.1 to 6.1 aluminum; 2.2 to 3.2 tin; 2.1 to 3.1 zirconium; 3.3 to 4.3 molybdenum; 3.3 to 4.3 chromium; 0.08 to 0.15 oxygen; 0.03 to 0.11 silicon; 0 to 0.30 iron; titanium; and impurities.

In accordance with a fourteenth non-limiting aspect of the present disclosure, which may be used in combination with each or any of the above-mentioned aspects, the titanium alloy comprises, in weight percentages based on total alloy weight: 5.6 to 5.8 aluminum; 2.5 to 2.7 tin; 2.6 to 2.7 zirconium; 3.8 to 4.0 molybdenum; 3.7 to 3.8 chromium; 0.08 to 0.14 oxygen; 0.03 to 0.05 silicon; up to 0.06 iron; titanium; and impurities.

In accordance with a fifteenth non-limiting aspect of the present disclosure, which may be used in combination with each or any of the above-mentioned aspects, the titanium alloy further comprises, in weight percentages based on total alloy weight: 0 to 0.05 nitrogen; 0 to 0.05 carbon; 0 to 0.015 hydrogen; and 0 up to 0.1 each of niobium, tungsten, hafnium, nickel, gallium, antimony, vanadium, tantalum, manganese, cobalt, and copper.

In accordance with a sixteenth non-limiting aspect of the present disclosure, which may be used in combination with each or any of the above-mentioned aspects, the titanium alloy comprises an aluminum equivalent value of at least 6.9 and a molybdenum equivalent value of 7.4 to 12.8, and exhibits an ultimate tensile strength of at least 150 ksi at 316° C.

In accordance with a seventeenth non-limiting aspect of the present disclosure, which may be used in combination with each or any of the above-mentioned aspects, the titanium alloy comprises an aluminum equivalent value of at least 6.9 and a molybdenum equivalent value of 7.4 to 12.8, and exhibits a yield strength of at least 130 ksi at 316° C.

In accordance with an eighteenth non-limiting aspect of the present disclosure, which may be used in combination with each or any of the above-mentioned aspects, the titanium alloy comprises an aluminum equivalent value of at least 6.9 and a molybdenum equivalent value of 7.4 to 12.8, and exhibits a time to 0.2% creep strain of no less than 86 hours at 427° C. under a load of 60 ksi.

In accordance with a nineteenth non-limiting aspect of the present disclosure, which may be used in combination with each or any of the above-mentioned aspects, the titanium alloy comprises an aluminum equivalent value of 6.9 to 9.5 and a molybdenum equivalent value of 7.4 to 12.8, and exhibits an ultimate tensile strength of at least 150 ksi at 316° C.

In accordance with a twentieth non-limiting aspect of the present disclosure, which may be used in combination with each or any of the above-mentioned aspects, the titanium alloy comprises an aluminum equivalent value of 8.0 to 9.5 and a molybdenum equivalent value of 7.4 to 12.8, and exhibits a yield strength of at least 130 ksi at 316° C.

In accordance with a twenty-first non-limiting aspect of the present disclosure, which may be used in combination with each or any of the above-mentioned aspects, the titanium alloy comprises an aluminum equivalent value of 8.0 to 9.5 and a molybdenum equivalent value of 7.4 to 12.8, and exhibits a time to 0.2% creep strain of no less than 86 hours at 427° C. under a load of 60 ksi.

In accordance with a twenty-second non-limiting aspect of the present disclosure, which may be used in combination with each or any of the above-mentioned aspects, the titanium alloy is made by a process comprising: solution treating the titanium alloy at 800° C. to 860° C. for 4 hours; water quenching the titanium alloy to ambient temperature; aging the titanium alloy at 620° C. to 650° C. for 8 hours; and air cooling the titanium alloy.

In accordance with a twenty-third non-limiting aspect of the present disclosure, the present disclosure also provides a method for making an alloy, comprising: solution treating a titanium alloy at 800° C. to 860° C. for 4 hours, wherein the titanium alloy comprises 5.5 to 6.5 aluminum, 1.9 to 2.9 tin, 1.8 to 3.0 zirconium, 4.5 to 5.5 molybdenum, 4.2 to 5.2 chromium, 0.08 to 0.15 oxygen, 0.03 to 0.20 silicon, 0 to 0.30 iron, titanium, and impurities; cooling the titanium alloy to ambient temperature at a rate depending on a cross-sectional thickness of the titanium alloy; aging the titanium alloy at 620° C. to 650° C. for 8 hours; and air cooling the titanium alloy.

In accordance with a twenty-fourth non-limiting aspect of the present disclosure, which may be used in combination with each or any of the above-mentioned aspects, the titanium alloy further comprises, in weight percentages based on total alloy weight, 0 to 0.05 nitrogen, 0 to 0.05 carbon, 0 to 0.015 hydrogen, and 0 up to 0.1 each of niobium, tungsten, hafnium, nickel, gallium, antimony, vanadium, tantalum, manganese, cobalt, and copper.

In accordance with a twenty-fifth non-limiting aspect of the present disclosure, the present disclosure also provides a method for making an alloy, comprising: solution treating a titanium alloy at 800° C. to 860° C. for 4 hours, wherein the titanium alloy comprises 5.1 to 6.1 aluminum, 2.2 to 3.2 tin, 1.8 to 3.1 zirconium, 3.3 to 4.3 molybdenum, 3.3 to 4.3 chromium, 0.08 to 0.15 oxygen, 0.03 to 0.20 silicon, 0 to 0.30 iron, titanium, and impurities; cooling the titanium alloy to ambient temperature at a rate depending on a cross-sectional thickness of the titanium alloy; aging the titanium alloy at 620° C. to 650° C. for 8 hours; and air cooling the titanium alloy.

In accordance with a twenty-sixth non-limiting aspect of the present disclosure, which may be used in combination with each or any of the above-mentioned aspects, the titanium alloy further comprises, in weight percentages based on total alloy weight, 0 to 0.05 nitrogen, 0 to 0.05 carbon, 0 to 0.015 hydrogen, and 0 up to 0.1 each of niobium, tungsten, hafnium, nickel, gallium, antimony, vanadium, tantalum, manganese, cobalt, and copper.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

We claim:

1. A titanium alloy comprising, in weight percentages based on total alloy weight:
- 5.1 to 6.1 aluminum;
- 2.2 to 3.2 tin;
- 1.8 to 3.1 zirconium;
- 3.3 to 4.3 molybdenum;
- 3.3 to 4.3 chromium;
- 0.08 to 0.15 oxygen;
- 0.03 to 0.05 silicon;
- greater than 0 to 0.30 iron;
- titanium; and
- impurities.

2. The titanium alloy of claim 1 comprising, in weight percentages based on total alloy weight:
- 5.1 to 6.1 aluminum;
- 2.2 to 3.2 tin;
- 2.1 to 3.1 zirconium;
- 3.3 to 4.3 molybdenum;
- 3.3 to 4.3 chromium;
- 0.08 to 0.15 oxygen;
- 0.03 to 0.05 silicon;
- greater than 0 to 0.30 iron;
- titanium; and
- impurities.

3. The titanium alloy of claim 1 comprising, in weight percentages based on total alloy weight:
- 5.6 to 5.8 aluminum;
- 2.5 to 2.7 tin;
- 2.6 to 2.7 zirconium;
- 3.8 to 4.0 molybdenum;
- 3.7 to 3.8 chromium;
- 0.08 to 0.14 oxygen;
- 0.03 to 0.05 silicon;
- greater than 0 to 0.06 iron;
- titanium; and
- impurities.

4. The titanium alloy of claim 1 further comprising, in weight percentages based on total alloy weight:
- 0 to 0.05 nitrogen;
- 0 to 0.05 carbon;
- 0 to 0.015 hydrogen; and
- 0 up to 0.1 each of niobium, tungsten, hafnium, nickel, gallium, antimony, vanadium, tantalum, manganese, cobalt, and copper.

5. The titanium alloy of claim 1, wherein the titanium alloy comprises an aluminum equivalent value of at least 6.9 and a molybdenum equivalent value of 7.4 to 12.8, and exhibits an ultimate tensile strength of at least 150 ksi at 316° C.

6. The titanium alloy of claim 1, wherein the titanium alloy comprises an aluminum equivalent value of at least 6.9 and a molybdenum equivalent value of 7.4 to 12.8, and exhibits a yield strength of at least 130 ksi at 316° C.

7. The titanium alloy of claim 1, wherein the titanium alloy comprises an aluminum equivalent value of at least 6.9 and a molybdenum equivalent value of 7.4 to 12.8, and exhibits a time to 0.2% creep strain of no less than 86 hours at 427° C. under a load of 60 ksi.

8. The titanium alloy of claim 1, wherein the titanium alloy comprises an aluminum equivalent value of 6.9 to 9.5 and a molybdenum equivalent value of 7.4 to 12.8, and exhibits an ultimate tensile strength of at least 150 ksi at 316° C.

9. The titanium alloy of claim 1, wherein the titanium alloy comprises an aluminum equivalent value of 8.0 to 9.5 and a molybdenum equivalent value of 7.4 to 12.8, and exhibits a yield strength of at least 130 ksi at 316° C.

10. The titanium alloy of claim 1, wherein the titanium alloy comprises an aluminum equivalent value of 8.0 to 9.5 and a molybdenum equivalent value of 7.4 to 12.8, and exhibits a time to 0.2% creep strain of no less than 86 hours at 427° C. under a load of 60 ksi.

11. The titanium alloy of claim 1 made by a process comprising:

solution treating the titanium alloy at 800° C. to 860° C. for 4 hours;

cooling the titanium alloy to ambient temperature at a rate depending on a cross-sectional thickness of the titanium alloy;

aging the titanium alloy at 620° C. to 650° C. for 8 hours; and air cooling the titanium alloy.

12. A method for making an alloy, comprising:

solution treating a titanium alloy at 800° C. to 860° C. for 4 hours, wherein the titanium alloy comprises, in weight percentages based on total alloy weight, 5.1 to 6.1 aluminum, 2.2 to 3.2 tin, 1.8 to 3.1 zirconium, 3.3 to 4.3 molybdenum, 3.3 to 4.3 chromium, 0.08 to 0.15 oxygen, 0.03 to 0.05 silicon, greater than 0 to 0.30 iron, titanium, and impurities;

cooling the titanium alloy to ambient temperature at a rate depending on a cross-sectional thickness of the titanium alloy;

aging the titanium alloy at 620° C. to 650° C. for 8 hours; and air cooling the titanium alloy.

13. The method of claim 12, wherein the titanium alloy further comprises, in weight percentages based on total alloy weight, 0 to 0.05 nitrogen, 0 to 0.05 carbon, 0 to 0.015 hydrogen, and 0 up to 0.1 each of niobium, tungsten, hafnium, nickel, gallium, antimony, vanadium, tantalum, manganese, cobalt, and copper.

14. The method of claim 12, wherein the titanium alloy comprises, in weight percentages based on total alloy weight, 5.1 to 6.1 aluminum, 2.2 to 3.2 tin, 2.1 to 3.1 zirconium, 3.3 to 4.3 molybdenum, 3.3 to 4.3 chromium, 0.08 to 0.15 oxygen, 0.03 to 0.05 silicon, greater than 0 to 0.30 iron, titanium, and impurities.

15. The method of claim 14, wherein the titanium alloy further comprises, in weight percentages based on total alloy weight, 0 to 0.05 nitrogen, 0 to 0.05 carbon, 0 to 0.015 hydrogen, and 0 up to 0.1 each of niobium, tungsten, hafnium, nickel, gallium, antimony, vanadium, tantalum, manganese, cobalt, and copper.

16. A titanium alloy comprising, in weight percentages based on total alloy weight:

5.1 to 6.1 aluminum;
2.2 to 3.2 tin;
1.8 to 3.1 zirconium;
3.3 to 4.3 molybdenum;
3.3 to 4.3 chromium;
0.08 to 0.15 oxygen;
0.03 to 0.20 silicon;
0 to 0.1 copper;
greater than 0 to 0.30 iron;
titanium; and
impurities.

17. The titanium alloy of claim 16 comprising, in weight percentages based on total alloy weight:

5.1 to 6.1 aluminum;
2.2 to 3.2 tin;
2.1 to 3.1 zirconium;
3.3 to 4.3 molybdenum;
3.3 to 4.3 chromium;
0.08 to 0.15 oxygen;
0.03 to 0.20 silicon;
0 to 0.1 copper;
greater than 0 to 0.30 iron;
titanium; and
impurities.

18. The titanium alloy of claim 16 comprising, in weight percentages based on total alloy weight:

5.6 to 5.8 aluminum;
2.5 to 2.7 tin;
2.6 to 2.7 zirconium;
3.8 to 4.0 molybdenum;
3.7 to 3.8 chromium;
0.08 to 0.14 oxygen;
0.03 to 0.05 silicon;
0 to 0.1 copper;
greater than 0 to 0.06 iron;
titanium; and impurities.

19. The titanium alloy of claim 16 further comprising, in weight percentages based on total alloy weight:

0 to 0.05 nitrogen;
0 to 0.05 carbon;
0 to 0.015 hydrogen; and
0 up to 0.1 each of niobium, tungsten, hafnium, nickel, gallium, antimony, vanadium, tantalum, manganese, and cobalt.

20. The titanium alloy of claim 16, wherein the titanium alloy comprises an aluminum equivalent value of at least 6.9 and a molybdenum equivalent value of 7.4 to 12.8, and exhibits an ultimate tensile strength of at least 150 ksi at 316° C.

21. The titanium alloy of claim 16, wherein the titanium alloy comprises an aluminum equivalent value of at least 6.9 and a molybdenum equivalent value of 7.4 to 12.8, and exhibits a yield strength of at least 130 ksi at 316° C.

22. The titanium alloy of claim 16, wherein the titanium alloy comprises an aluminum equivalent value of at least 6.9 and a molybdenum equivalent value of 7.4 to 12.8, and exhibits a time to 0.2% creep strain of no less than 86 hours at 427° C. under a load of 60 ksi.

23. The titanium alloy of claim 16, wherein the titanium alloy comprises an aluminum equivalent value of 6.9 to 9.5 and a molybdenum equivalent value of 7.4 to 12.8, and exhibits an ultimate tensile strength of at least 150 ksi at 316° C.

24. The titanium alloy of claim 16, wherein the titanium alloy comprises an aluminum equivalent value of 8.0 to 9.5 and a molybdenum equivalent value of 7.4 to 12.8, and exhibits a yield strength of at least 130 ksi at 316° C.

25. The titanium alloy of claim 16, wherein the titanium alloy comprises an aluminum equivalent value of 8.0 to 9.5 and a molybdenum equivalent value of 7.4 to 12.8, and exhibits a time to 0.2% creep strain of no less than 86 hours at 427° C. under a load of 60 ksi.

26. A titanium alloy comprising, in weight percentages based on total alloy weight:

5.1 to 6.1 aluminum;
2.2 to 3.2 tin;
1.8 to 3.1 zirconium;
3.3 to 4.3 molybdenum;
3.3 to 4.3 chromium;
0.08 to 0.15 oxygen;
0.03 to 0.20 silicon;
0 to 0.1 vanadium;
greater than 0 to 0.30 iron;
titanium; and
impurities.

27. The titanium alloy of claim 26 comprising, in weight percentages based on total alloy weight:

5.1 to 6.1 aluminum;
2.2 to 3.2 tin;
2.1 to 3.1 zirconium;
3.3 to 4.3 molybdenum;
3.3 to 4.3 chromium;
0.08 to 0.15 oxygen;
0.03 to 0.20 silicon;
0 to 0.1 vanadium;
greater than 0 to 0.30 iron;
titanium; and
impurities.

28. The titanium alloy of claim 26 comprising, in weight percentages based on total alloy weight:

5.6 to 5.8 aluminum;
2.5 to 2.7 tin;
2.6 to 2.7 zirconium;
3.8 to 4.0 molybdenum;
3.7 to 3.8 chromium;
0.08 to 0.14 oxygen;
0.03 to 0.05 silicon;
0 to 0.1 vanadium;
greater than 0 to 0.06 iron;
titanium; and
impurities.

29. The titanium alloy of claim 26 further comprising, in weight percentages based on total alloy weight:

0 to 0.05 nitrogen;
0 to 0.05 carbon;
0 to 0.015 hydrogen; and
0 up to 0.1 each of niobium, tungsten, hafnium, nickel, gallium, antimony, tantalum, manganese, cobalt, and copper.

30. The titanium alloy of claim 26, wherein the titanium alloy comprises an aluminum equivalent value of at least 6.9 and a molybdenum equivalent value of 7.4 to 12.8, and exhibits an ultimate tensile strength of at least 150 ksi at 316° C.

31. The titanium alloy of claim 26, wherein the titanium alloy comprises an aluminum equivalent value of at least 6.9 and a molybdenum equivalent value of 7.4 to 12.8, and exhibits a yield strength of at least 130 ksi at 316° C.

32. The titanium alloy of claim 26, wherein the titanium alloy comprises an aluminum equivalent value of at least 6.9 and a molybdenum equivalent value of 7.4 to 12.8, and exhibits a time to 0.2% creep strain of no less than 86 hours at 427° C. under a load of 60 ksi.

33. The titanium alloy of claim 26, wherein the titanium alloy comprises an aluminum equivalent value of 6.9 to 9.5 and a molybdenum equivalent value of 7.4 to 12.8, and exhibits an ultimate tensile strength of at least 150 ksi at 316° C.

34. The titanium alloy of claim 26, wherein the titanium alloy comprises an aluminum equivalent value of 8.0 to 9.5 and a molybdenum equivalent value of 7.4 to 12.8, and exhibits a yield strength of at least 130 ksi at 316° C.

35. The titanium alloy of claim 26, wherein the titanium alloy comprises an aluminum equivalent value of 8.0 to 9.5 and a molybdenum equivalent value of 7.4 to 12.8, and exhibits a time to 0.2% creep strain of no less than 86 hours at 427° C. under a load of 60 ksi.

36. A titanium alloy comprising, in weight percentages based on total alloy weight:

5.1 to 6.1 aluminum;
2.2 to 3.2 tin;
1.8 to 3.1 zirconium;
3.3 to 4.3 molybdenum;
3.3 to 4.3 chromium;
0.08 to 0.15 oxygen;
0.03 to 0.20 silicon;
greater than 0 to 0.30 iron;
0 to 0.05 nitrogen;
0 to 0.05 carbon;
0 to 0.015 hydrogen; and
0 up to 0.1 each of niobium, tungsten, hafnium, nickel, gallium, antimony, vanadium, tantalum, manganese, cobalt, and copper; and
titanium.

37. A titanium alloy comprising, in weight percentages based on total alloy weight:

5.6 to 5.8 aluminum;
2.5 to 2.7 tin;
2.6 to 2.7 zirconium;
3.8 to 4.0 molybdenum;
3.7 to 3.8 chromium;
0.08 to 0.14 oxygen;
0.03 to 0.05 silicon;
greater than 0 to 0.06 iron;
0 to 0.05 nitrogen;
0 to 0.05 carbon;
0 to 0.015 hydrogen;
0 up to 0.1 each of niobium, tungsten, hafnium, nickel, gallium, antimony, vanadium, tantalum, manganese, cobalt, and copper; and
1titanium.

* * * * *